US008322108B2

(12) United States Patent
Lee et al.

(10) Patent No.: US 8,322,108 B2
(45) **Date of Patent: *Dec. 4, 2012**

(54) POST-TENSION INTERSECTION CHAIR

(75) Inventors: Kenneth Lee, Anaheim, CA (US); Clifford D. Bennett, Fontana, CA (US)

(73) Assignee: Dayton Superior Corporation, Dayton, OH (US)

( * ) Notice: Subject to any disclaimer, the term of this patent is extended or adjusted under 35 U.S.C. 154(b) by 2013 days.

This patent is subject to a terminal disclaimer.

(21) Appl. No.: 11/169,430

(22) Filed: Jul. 20, 2005

(65) Prior Publication Data

US 2006/0032179 A1 Feb. 16, 2006

Related U.S. Application Data

(63) Continuation-in-part of application No. 10/301,311, filed on Nov. 21, 2002, now Pat. No. 6,925,771.

(51) Int. Cl.
*E04C 5/16* (2006.01)

(52) U.S. Cl. ..... 52/677; 52/685; 52/686; 52/687

(58) Field of Classification Search ..... 52/677, 52/685, 686, 687; 248/248; D8/354; D25/199
See application file for complete search history.

(56) References Cited

U.S. PATENT DOCUMENTS

| | | | | | |
|---|---|---|---|---|---|
| 2,407,249 | A | | 9/1946 | Burner et al. | 72/122 |
| 3,255,565 | A | * | 6/1966 | Menzel | 52/678 |
| 3,673,753 | A | | 7/1972 | Anderson | 52/685 |
| 3,693,310 | A | * | 9/1972 | Middleton | 52/685 |
| 3,830,032 | A | * | 8/1974 | Robb | 52/687 |
| 4,598,523 | A | * | 7/1986 | Tolliver | 52/685 |
| 4,644,727 | A | * | 2/1987 | Hanson et al. | 52/687 |
| 4,655,023 | A | | 4/1987 | Yung | 52/685 |
| 5,107,654 | A | | 4/1992 | Leonardis | 52/685 |
| 5,729,949 | A | | 3/1998 | Hartzheim | 52/677 |
| 5,791,095 | A | | 8/1998 | Sorkin | 52/105 |
| 6,089,522 | A | * | 7/2000 | Haslem et al. | 248/440 |
| 6,276,108 | B1 | * | 8/2001 | Padrun | 52/684 |
| 6,684,595 | B1 | * | 2/2004 | Sorkin | 52/685 |
| 6,837,017 | B2 | * | 1/2005 | Hardy et al. | 52/685 |
| 6,925,771 | B2 | | 8/2005 | Lee et al. | 52/685 |
| 6,962,029 | B2 | * | 11/2005 | Lowery et al. | 52/682 |
| 7,028,443 | B2 | * | 4/2006 | Bennett et al. | 52/686 |
| 2003/0000170 | A1 | * | 1/2003 | Sorkin | 52/677 |

FOREIGN PATENT DOCUMENTS

| | | |
|---|---|---|
| GB | 575043 | 1/1946 |

* cited by examiner

*Primary Examiner* — Mark Wendell
(74) *Attorney, Agent, or Firm* — Thompson Hine L.L.P.

(57) ABSTRACT

A chair for supporting and spacing post-tension cables having a generally tapered body with an upper receiving area for securing the cables and a planar base adapted to rest on a flat support surface. The body has inner and outer surfaces that are substantially complementary to one another to allow a plurality of chairs to be stacked together. The receiving area includes posts extending upwardly between notches. The posts define passageways for guiding the cables into the notches. Detents project inwardly from the tops of the posts and fixedly retain the bars within the passageways. The chair may be formed from a resilient polymeric material.

5 Claims, 5 Drawing Sheets

POST-TENSION INTERSECTION CHAIR

This application is a continuation-in-part of U.S. patent application Ser. No. 10/301,311 filed Nov. 21, 2002, now U.S. Pat. No. 6,925,771.

FIELD OF THE INVENTION

The present invention relates generally to chairs and spacers that are used in construction activities for the support of steel reinforcement members, and, in particular, to stackable chairs that are reliably able to retain post-tension cables, reinforcement bars, rods, mesh, and the like.

BACKGROUND OF THE INVENTION

Chairs or spacers are commonly used in the construction industry for the support and positioning of post-tension cables and/or reinforcement bars ("rebars") a proper distance above a surface. The bars or cables are usually arranged in rows or grids within an area into which concrete is to be poured. They are held loosely in place while concrete is placed around them. In normal use, a receiving area formed on the chair will contact and support the cable or bar while the base of the chair rests on a deck or on a grade.

Post-tension cables differ from ordinary rebars in that they are high tensile strength steel cables that are pulled tightly after the concrete is poured. The reinforcing cable or tendon is stretched by hydraulic jacks and securely anchored into place just after the concrete is poured. When the concrete has set, it holds the steel in a tight grip, preventing slippage or sagging. Proper spacing and arrangement of post-tension cables, as well as rebars, according to known engineering and architectural specifications, impacts the structural strength and integrity of the concrete structure. Additionally, proper spacing of the bars away from the outer surfaces of the concrete structure helps prevent moisture from reaching and deteriorating the bars.

Various U.S. and foreign patents have issued on devices relating to chairs. Some prior art chairs have desirable features, such as stackability, or retention means for the reinforcement members. For example, U.S. Pat. No. 5,729,949, to Hartzheim discloses a readily stackable chair with a hollow-conical body that minimizes the amount of shipping and storage space required. This chair has support legs with apertures between them to allow concrete to flow into the hollow interior of the chair. A worker can carry many chairs at one time and place numerous chairs at a construction site without repeated trips to a storage area.

Some prior art chairs include retention means or clips for use in connecting reinforcing members together. U.S. Pat. No. 3,673,753 discloses a chair designed to have the reinforcing rod snap into a clamp and be securely maintained therein by hooks. The chair of U.S. Pat. No. 6,276,108 has a clip mounted on a post. The clip has a pair of orthogonal sockets for connecting reinforcement rods together at right angles to each other. Both of these patents disclose retention means which are designed for use with intersecting or crossing bars, and provide an attractive alternative to the wires which are widely used for tying reinforcing bars together. However, these prior art chairs are not able to be stacked, and therefore require an inordinate amount of space for shipping and storage.

While the prior art chairs described above fulfill their respective, particular objectives, a further need exists for a chair that is adapted to not only secure reliably the reinforcement members but also be stackable for more efficient shipping and storage. Also, a need exists for such a chair that has the strength and stability to withstand demanding and rigorous work loads.

SUMMARY OF THE INVENTION

Accordingly, one objective of the present invention is to provide a chair that fixedly retains reinforcement members such as post-tension cables and rebars, thereby eliminating wire tying of the reinforcement members. Another objective of the invention is to provide post-tension chairs that can be stacked within one another to provide a more efficient method for packaging, storage, and shipment. It is a further objective of the present invention to provide a chair with a wide base that allows the chair to stand securely. It is also an objective to provide a plastic chair made of durable, non-corrosive materials that is easy to manufacture and easy to use with post-tension cables.

Briefly stated, these objectives are accomplished by a tapered post-tension intersection chair having a hollow body with a receiving area that fixedly retains the post-tension cables and a wide base which is adapted to rest on a flat support surface. An upper opening is defined by the receiving area and a lower opening is defined by the base. The body generally is tapered, having multiple straight sides and a polygonal cross-section, with an inner surface that is complementary to the outer surface. The chair may also have an elliptical, oval or hybrid cross-section, such as a square with rounded corners.

In accordance with one aspect of the invention, the receiving area secures and retains the post-tension cables in intersecting relationships to each other. In accordance with another aspect of the invention, the lower opening is larger than the upper opening, and the inner and outer surfaces are substantially complementary to each other, to allow a plurality of chairs to be stacked together, one inside the other, for storage and shipment.

In one embodiment of the invention, the receiving area has a plurality of notches, posts, and detents which cooperate to snap-fit or retain the post-tension cables within the receiving area. The posts project upwardly between the notches and terminate with the detents, which face horizontally inwardly. The reinforcement bars are inserted through the upper opening and over the detents, fitting into passageways which are defined by adjacent posts. The bars are then seated in intersecting relationships in the notches, retained in the passageways by the detents and posts.

In another embodiment of the invention, the base has a plurality of separate support legs extending downwardly from the receiving area. Adjacent support legs define apertures or holes between them, which allow poured concrete to pass fluidly through the chair. In yet another embodiment, a foot member extends horizontally outwardly from each of the legs. The foot member is preferably a singular flattened, disc-like platform that interconnects the legs, forming a solid band of material around the lower opening. Alternatively, each of the legs can be attached to an extending foot member, such that there are as many foot members as there are legs.

In accordance with another aspect of the invention, the receiving area and the base are integrally formed together from a durable, non-corrosive polymeric material. The chairs are easy to manufacture in this fashion, and packaging and storage of the chairs can be done quickly and easily because the chairs are also stackable. These and other aspects of the present invention will be more fully appreciated with respect to the following drawings and detailed description.

DETAILED DESCRIPTION OF THE INVENTION

Figure 1:
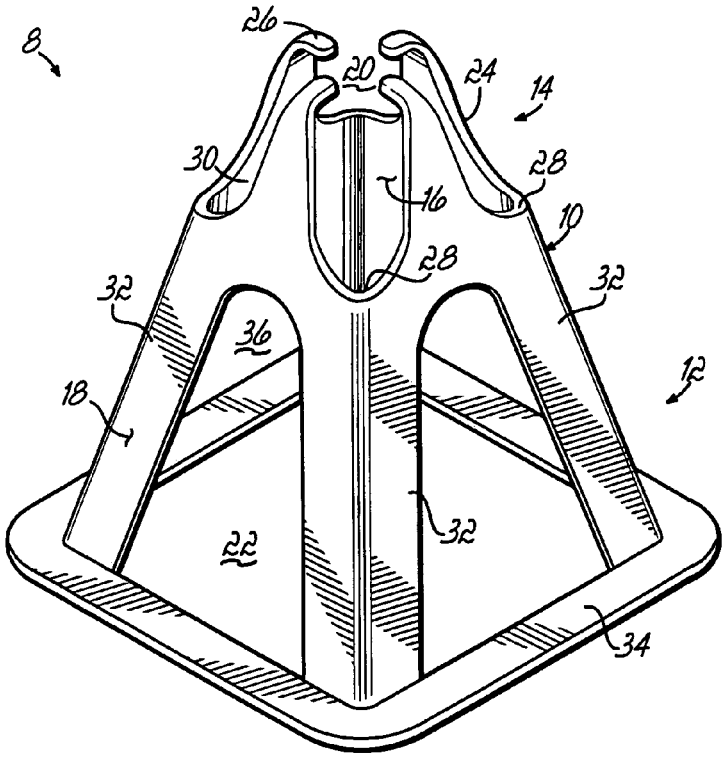
FIG. 1 is a perspective view of one embodiment of the chair of the present invention.

Referring now to FIG. 1, a perspective view is shown of one embodiment of the post-tension chair 8 of the present invention having a hollow body 10 including a base 12, a receiving area 14, an inner surface 16, and an outer surface 18. There is an upper opening 20 defined by receiving area 14 and a lower opening 22 defined by base 12. Upper receiving area 14 has a plurality of posts 24 with inwardly facing detents 26. Posts 24 project upwardly between generally rounded notches 28. Between notches 28 are passageways 30 defined by posts 24. Lower base 12 has a plurality of separate support legs 32 extending downwardly from receiving area 14. A foot member 34 extends horizontally outwardly from legs 32. Adjacent support legs 32 define holes or apertures 36, which allow poured concrete to fluidly pass through chair 8.

The chair of FIG. 1 is generally polygonal in cross-section and constructed of a single piece of resilient polymeric material. However, alternative embodiments of the chair may have an elliptical, oval or hybrid cross-section, such as a square with rounded corners. In accordance with one aspect of the invention, multiple chairs can be stacked within one another to provide a more efficient method for packaging and shipment, as will be described in more detail with reference to FIG. 4. Inner surface 16 is complementary to outer surface 18, and body 10 has multiple straight sides and is generally tapered, with lower opening 22 being larger than upper opening 20. The tapered shape of the chair also requires that the upper portion of body 10, including receiving area 14, is generally relatively narrow as compared to the lower portion, which includes the wider base 12.

Figure 2:
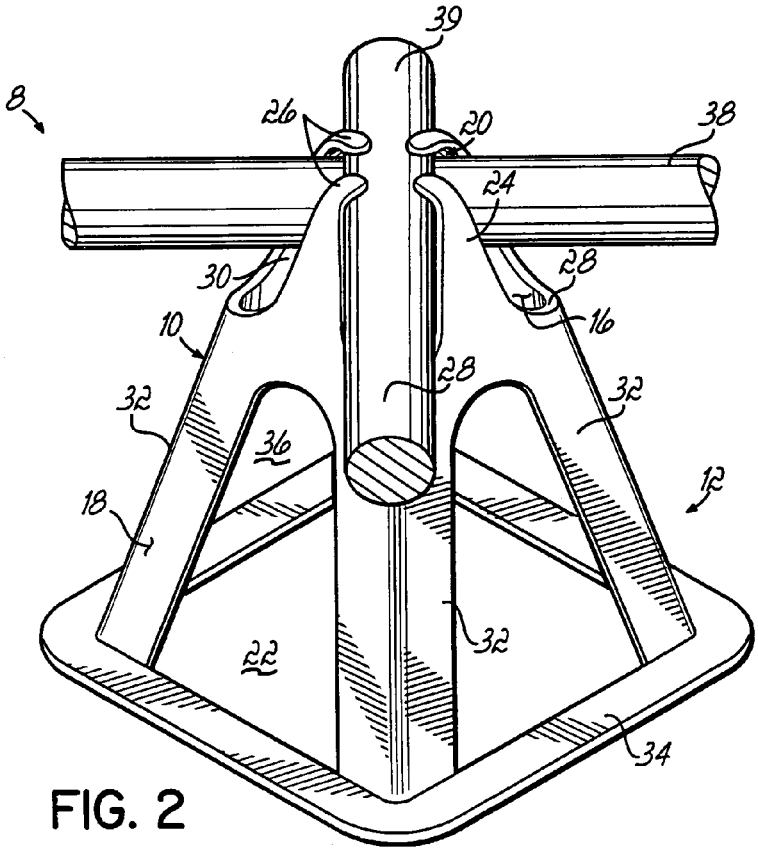
FIG. 2 is a perspective view of the chair of FIG. 1 in which post-tension cables have been placed in the receiving area.

FIG. 2 shows post-tension cables 38 and 39 being supported by the chair of FIG. 1. Post-tension cables 38 and 39, either in the form of post-tension cable or rebar, are arranged in intersecting or orthogonal relationships to one another within receiving area 14, and are fixed or retained at these points of intersection by a cooperative relationship between notches 28, posts 24, and detents 26. Detents 26 project or extend horizontally inwardly from posts 24 and are designed to retain fixedly, or snap-fit, post-tension cables 38 and 39 into position within passageways 30. As a non-limiting example, first post-tension cable 38.is initially inserted into upper opening 20 and then snapped or pushed over detents 26. First post-tension cable 38 then passes through passageways 30 between posts 24 and rests in notches 28. Notches 28 are curved in a semicircular fashion to receive and support post-tension cable 38. Next, second post-tension cable 39 is aligned, in an orthogonal position for example, relative to first post-tension cable 38, and also slidably snap-fitted over detents 26. Second post-tension cable 39, as illustrated in FIG. 2, is retained between posts 24 and detents 26 and rests above first post-tension cable 38.

Figure 3:
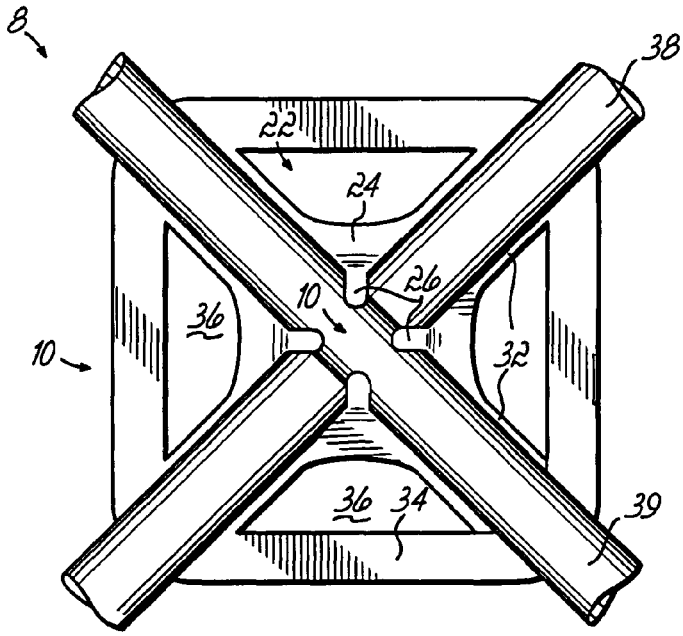
FIG. 3 is a top view of the chair of FIG. 2.

FIG. 3 is a top view of the chair of FIG. 2 and shows the orthogonal or intersecting relationship between post-tension cables 38 and 39 retained within the receiving area of chair 8. Post-tension cable 38 sits below post-tension cable 39 within notches 28. Each post-tension cable 38, 39 fits within a passageway 30 (see FIGS. 1 and 2) defined by posts 24. Detents 26 project or extend horizontally inwardly from posts 24 to secure or otherwise fixedly retain top post-tension cable 39 in proper position, while bottom post-tension cable 38 sits within notches 28 and is fixedly retained in this position by posts 24, as well as by post-tension cable 39. Wire ties are not necessary to secure post-tension cables 38 and 39 within the receiving area, thereby making assembly of the structure more efficient.

FIG. 3 further illustrates the tapered, polygonal shape of chair 8. The upper portion of body 10 is narrow at upper opening 20 between detents 26. Body 10 gradually widens from detents 26 down to foot member 34. Lower opening 22 is much larger than upper opening 20, with upper opening 20 being the geographical center of the polygonally shaped chair 8 and support legs 32 proceeding in a straight line from beneath notches 28 to foot member 34. Disc-like foot member 34 extends horizontally outwardly from support legs 32, forming a wide base adapted to support the weight of chair 8, including post-tension cables 38 and 39. Apertures 36 between support legs 32 allow fluid concrete to pass through body 10 beneath the level of post-tension cables 38, 39.

Referring now to FIGS. 1 and 2, a side view of the chair of FIG. 2 shows the large openings provided by apertures 36 which maximize the free flow of concrete into and around chair 8. Apertures 36 are in a generally triangular shape, but are curved at the apex. One of skill in the art will recognize, however, that a variety of shapes, sizes, and numbers of apertures can be used. Support legs 32 are generally of sufficient width and strength to support a substantial load, such as the force of post-tension cables 38 and 39 as well as the force applied by construction workers who may step or walk on the supported cables 38, 39 during the construction process. Foot member 34 is a flat, disc-like platform, allowing chair 8 to rest on a flat, planar support surface, such as dirt, sand, or the like, while supporting a substantial load.

In the embodiment shown in FIGS. 1 through 5, foot member 34 is manufactured as a singular, flattened, disc-like platform that interconnects legs 32, forming a solid band of material around lower opening 22. Foot member 34 allows base 12 to rest on a flat, planar support surface, including loose or pliant surfaces such as dirt, sand, or the like, without sinking under the weight of the post-tension cables. In FIGS. 2 and 3, detents 26 are shown securing post-tension cable 39 in place, and posts 24 form passageways 30 that align cables 38 and 39 in intersecting relationships to each other. Post-tension cable 38 rests within notches 28, and post-tension cable 39 rests on top of cable 38, within passageways 30, and secured above by detents 26.

Figure 4:
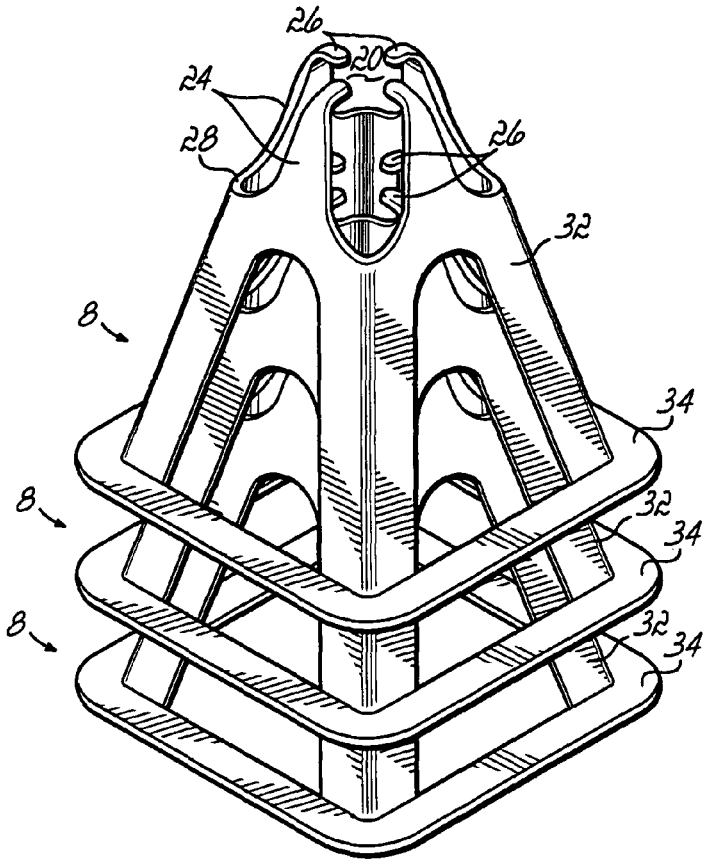
FIG. 4 is a perspective view of a plurality of chairs stacked within one another in accordance with one aspect of the invention.

As illustrated in FIG. 4, the combination of the tapered, generally funnel-like shape of body 10, along with the complementary surfaces 16,18, allows upper receiving area 14 of a first chair to be inserted within lower opening 22 of a second chair, such that outer surface 18 of the first chair slidably engages inner surface 16 of the second chair. In this manner, a plurality of chairs can be stacked together, one inside the other, for packaging, storage and shipment. The distance that a first chair is able to fit inside a second chair is dependant upon the degree of slope assumed by surfaces 16 and 18 as body 10 progresses from upper opening 20 to lower opening 22. That is, the smaller upper opening 20 is relative to lower opening 22, the greater the slope will be of surfaces 16 and 18. Preferably, the slope is sufficient to allow a substantial portion of the first chair to fit within the second chair, such that a great number of chairs can be stacked in a minimal amount of space without the stack becoming too tall or burdensome.

Figure 5:
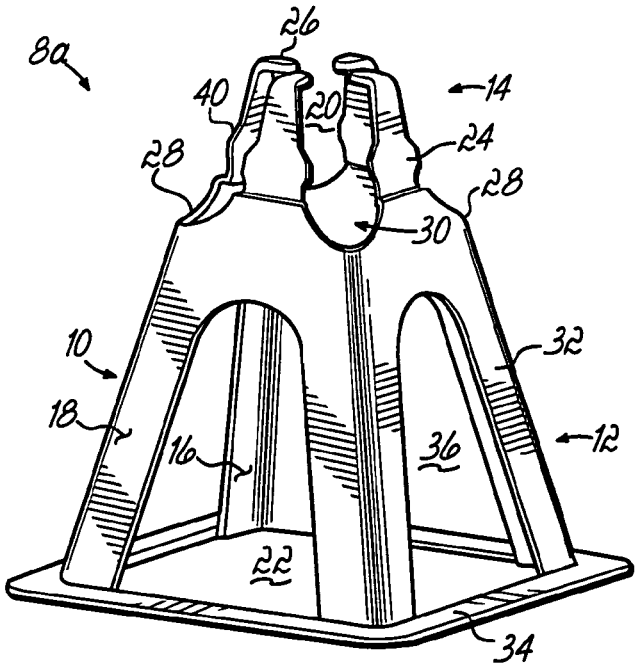
FIG. 5 is a perspective view of a second embodiment of a chair in accordance with one aspect of the present invention.

FIG. 5 illustrates another exemplary chair 8*a* of the present invention wherein components corresponding to like components of FIGS. 1-4 have been similarly numbered and in which each post 24 further includes a dentate catch 40 projecting into an adjacent passageway 30. One dentate catch 40 cooperates with another dentate catch 40 from an adjacent post 24 to form a narrow section within passageway 30 above notch 28. This narrowing of passageway 30 is intended to retain more securely a post-tension cable within notch 28. In this embodiment, posts 24 are set horizontally inward as they extend from the body. This adds flexibility to passageways 30, such that the narrowing created by dentate catches 40 does not block the cables from advancing into notches 28.

As a non-limiting example, a first cable is snap-fit over detents 26 and into passageways 30. Resistance will be met by dentate catches 40, but posts 24 are flexible/movable such that the narrowing within passageways 30 can be overcome by spreading posts 24 apart. The cable is then free to advance past dentate catches 40 and come to rest within notches 28. A second cable is then placed in an orthogonal relationship to the first member. This second member is secured by detents 26 and rests above dentate catches 40. The tops of dentate catches 40 will cooperate with the first cable to form a slot similar to notches 28 for the second cable. Dentate catches 40, therefore, add stability to the chair 8*a* by both securing the first cable within notches 28 and seating the second cable more securely within passageways 30.

Figure 6:
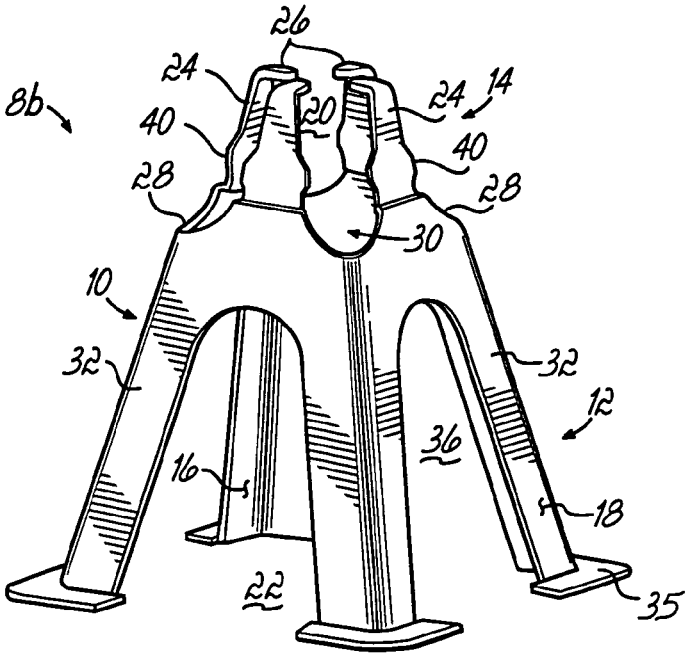
FIG. 6 is a perspective view of a third embodiment of a chair in accordance with one aspect of the present invention.

FIG. 6 is an illustration of another exemplary chair 8*b* of the present invention wherein like components have been correspondingly numbered and having a foot member 35 extending horizontally from each support leg 32. In this embodiment, there is no interconnection of support legs 32, such that there are as many foot members 35 as there are legs 32. Although foot members 35 do not interconnect legs 32 in a disc-like fashion, they still allow body 10 to be free-standing while supporting a substantial weight on soft grade surfaces. This embodiment is ideal for placement of chair 8*b* on a soft grade platform or surface where there is some unevenness of the surface.

Figure 7:
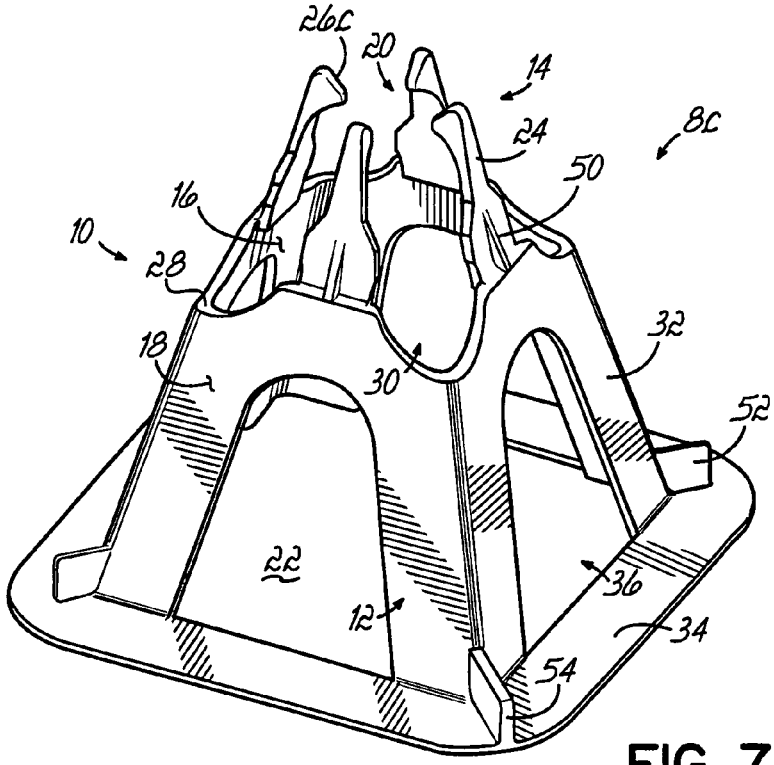
FIG. 7 is a perspective view of a fourth embodiment of a chair in accordance with one aspect of the present invention.
Figure 8:
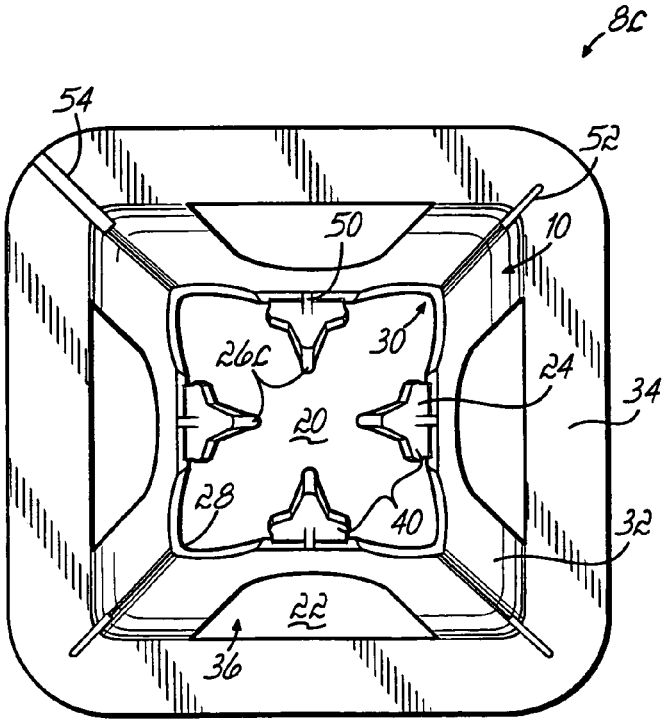
FIG. 8 is a top view of the chair of FIG. 7.

Referring now to FIGS. 7 and 8, there is shown still another exemplary chair 8*c*, similar to the chair 8*a* of FIG. 5. Chair 8*c* of FIGS. 7 and 8 further include strengthening ribs 50 formed into posts 24 proximate lower portions of the posts 24, generally where the posts 24 are offset inwardly from base 12. The ribs 50 extend generally longitudinally along the posts 24 and help to bias posts 24 inwardly to facilitate installation and retention of cables or rebar which may be inserted within the receiving portion 14. Chair 8*c* also illustrates an alternative form of the detents 26*c*, wherein detents 26*c* comprise formed projections extending inwardly toward the center of the chair 8*c*, as compared to the generally angled detents 26 of chairs 8, 8*a* and 8*b* of FIGS. 1-6. Advantageously, the top portions of detents 26*c* are sloped in the direction of base. 12 to facilitate the insertion of cables or rebar into the receiving portion 14.

Chair 8*c* further includes a plurality of projections 52, 54 extending upwardly from foot member 34 in a direction generally toward receiving portion 14. The projections may extend across the entire width of foot member 34 as depicted by projection 54, or may extend only part way across the width of foot member 34 as illustrated by projection 52. The projections 52, 54 help to maintain a separation between chairs 8*c* when they are stacked together, so that individual chairs 8*c* can be readily separated when desired. Projections 52, 54 also permit chairs 8*c* to be stacked together after being formed and while the chairs 8*c* are still hot, whereby the separation prevents confronting inner and outer surfaces 16, 18 from sticking together. In the exemplary embodiment shown, the projections 52, 54 are located adjacent legs 32 at generally diagonally opposite positions of foot member 12. In these locations, projections 52, 54 help to strengthen foot member 34, however, it will be recognized that projections 52, 54 may alternatively be formed in other locations on foot member 34.

Figure 9:
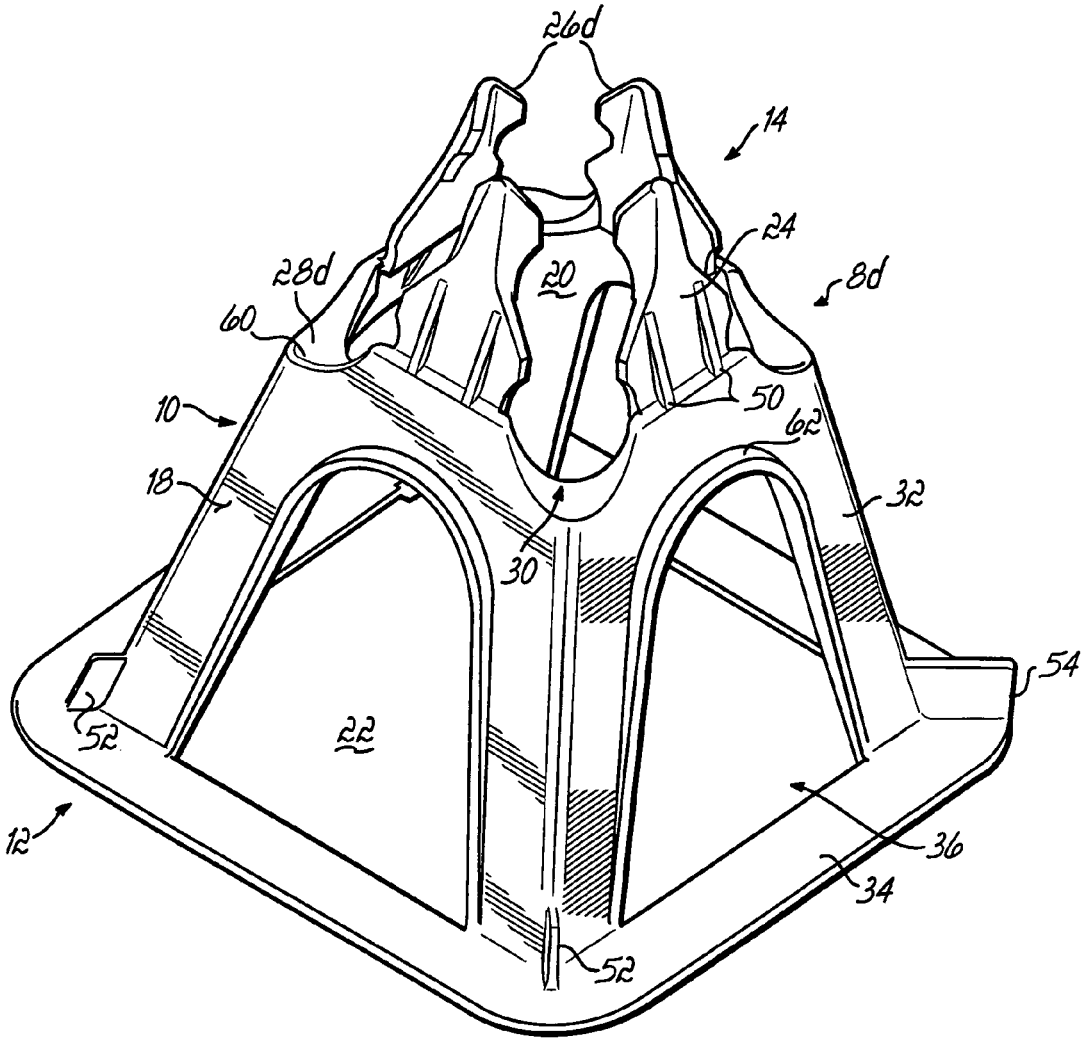
FIG. 9 is a perspective view of a fifth embodiment of a chair in accordance with one aspect of the present invention.

Referring now to FIG. 9, there is shown yet another exemplary chair 8*d*, similar to the chair of FIGS. 7 and 8, wherein similar features are similarly numbered. In this embodiment, the posts 24 are offset inwardly from the base 12 and are reinforced by pairs of ribs 50 extending generally longitudinally along each post 24 to facilitate the installation and retention of rebar or cables, as discussed above. Each post further includes a pair of detents 26*d*, one extending laterally outward from each opposite edge thereof. Each detent 26*d* is also angled inwardly such that opposing detents 26*d* located on adjacent posts 24 define sloped surfaces for guiding rebar or cables into the passageways 30. Once placed therein, the detents 26*b* help to retain the rebar or cables within the passageways 30.

Chair 8*d* also has notches 28*d* defined by inwardly extending flanged rims 60 which form saddles for receiving rebar or cable thereon. Generally outwardly extending flanged rims 62 are provided around each aperture 36 formed between support legs 32. The inwardly extending flanged rims 60 and outwardly extending flanged rims 62 further strengthen the chair 8*d* to support the load of the rebar and cables installed thereon.

Chair 8 is preferably constructed from a resilient polymeric material and, more specifically, is constructed of a plastic or resin material. Further, the chair is most preferably made of polypropylene and is one-piece injection molded. One of ordinary skill in the art will recognize that other materials exhibiting similar characteristics of being lightweight, strong and resilient can be used, such as polyethylene, a combination of polypropylene and polyethylene, and other known materials.

The present invention has been disclosed in detail in connection with the preferred embodiments. While there are many minor modifications that can be made without departing from the scope of the present invention, the scope of the present invention is defined by the claims that follow.

What is claimed is:

1. A post-tension cable chair, comprising:

a generally tapered body including a plurality of spaced legs having apertures therebetween sized to freely admit the flow of poured concrete therethrough;

said body having an inner surface and an outer surface, said inner and outer surfaces being substantially complementary to each other to allow a plurality of chairs to be stacked within one another for storage and shipment;

a plurality of resilient posts projecting upwardly from an upper receiving area and adapted to secure post-tension cables engaged thereby in intersecting relationships to each other;

at least one notch formed between adjacent pairs of posts to receive and support a cable, said posts defining a passageway above said notch; and a pair of detents projecting laterally outwardly from each post and angled inwardly toward a center of the chair such that opposing detents on adjacent posts define outwardly sloped surfaces for guiding a cable into said passageway.

2. The post-tension cable chair of claim 1, wherein for each post, said pair of detents project laterally outwardly from opposite edges of said post, one detent extending laterally outwardly from each opposite edge thereof.

3. A post-tension cable chair, comprising:

a generally tapered body including a plurality of spaced legs having apertures therebetween sized to freely admit the flow of poured concrete therethrough;

said body having an inner surface and an outer surface, said inner and outer surfaces being substantially complementary to each other to allow a plurality of chairs to be stacked within one another for storage and shipment;

a plurality of resilient posts projecting upwardly from an upper receiving area and adapted to secure post-tension cables engaged thereby in intersecting relationships to each other;

at least one notch formed between adjacent pairs of posts to receive and support a cable, said posts defining a passageway above said notch; and an inwardly extending flanged rim proximate a lower extent of each said notch, said flanged rim defining a saddle for supporting a cable inserted within said passageway.

4. The post-tension cable chair of claim 3, further comprising an outwardly extending flanged rim formed along adjacent spaced apart legs and around each said aperture therebetween.

5. The post-tension cable chair of claim 3, wherein said inwardly extending flanged rim is inwardly cantilevered from said receiving area.

* * * * *